US009970159B2

(12) United States Patent
Dhumpa et al.

(10) Patent No.: US 9,970,159 B2
(45) Date of Patent: May 15, 2018

(54) MANUFACTURE OF HYDRATED NANOCELLULOSE SHEETS FOR USE AS A DERMATOLOGICAL TREATMENT

(71) Applicant: Innovatech Engineering, LLC, Tallahassee, FL (US)

(72) Inventors: Raghuram Dhumpa, Tallahassee, FL (US); Kristopher Kelly, Tallahassee, FL (US)

(73) Assignee: Innovatech Engineering, LLC, Tallahassee, FL (US)

( * ) Notice: Subject to any disclaimer, the term of this patent is extended or adjusted under 35 U.S.C. 154(b) by 0 days. days.

(21) Appl. No.: 15/791,525

(22) Filed: Oct. 24, 2017

(65) Prior Publication Data

US 2018/0044856 A1 Feb. 15, 2018

Related U.S. Application Data

(63) Continuation-in-part of application No. 14/986,578, filed on Dec. 31, 2015, now Pat. No. 9,816,230.

(60) Provisional application No. 62/098,627, filed on Dec. 31, 2014.

(51) Int. Cl.

| | |
|---|---|
| ***D21H 11/18*** | (2006.01) |
| ***D21H 11/20*** | (2006.01) |
| ***D21H 15/02*** | (2006.01) |
| ***D04H 1/425*** | (2012.01) |
| ***D04H 1/4382*** | (2012.01) |
| ***D21H 25/02*** | (2006.01) |
| ***D21H 23/08*** | (2006.01) |

(52) U.S. Cl.

CPC ..... *D21H 11/18* (2013.01); *D04H 1/425* (2013.01); *D04H 1/4382* (2013.01); *D21H 11/20* (2013.01); *D21H 15/02* (2013.01); *D21H 23/08* (2013.01); *D21H 25/02* (2013.01)

(58) Field of Classification Search

CPC ..... D21H 11/18; D21H 21/18; D21H 11/12; D21H 11/20; D21H 17/37; D21H 17/44; D21H 17/63; D21H 17/375; D21H 17/24; D21H 17/28; D21H 17/29; D21H 17/52; D21H 17/55; D21H 17/70; D21H 17/74; D21H 19/42; D21H 23/04; D21H 27/00; D21F 11/14; D21C 9/007; D21C 5/005; D21C 9/002; D21C 5/00; D21C 9/001; D21C 9/18; B82Y 30/00; B82Y 40/00; H05K 2201/0284; Y10T 442/60; Y10T 442/613; Y10T 442/614; B01D 2239/025; B01D 39/18; D21B 1/16; Y10S 977/962; Y10S 977/963

See application file for complete search history.

(56) References Cited

U.S. PATENT DOCUMENTS

| | | | | |
|---|---|---|---|---|
| 5,964,983 | A | 10/1999 | Dinand et al. | |
| 6,074,523 | A | 6/2000 | Mizobuchi et al. | |
| 6,541,627 | B1 * | 4/2003 | Ono | C08J 3/03 106/163.01 |
| 7,381,294 | B2 | 6/2008 | Suzuki et al. | |
| 8,183,426 | B2 * | 5/2012 | Cole | A61L 2/238 502/439 |
| 8,268,391 | B2 | 9/2012 | Ioelovich et al. | |
| 8,317,978 | B1 | 11/2012 | Manning et al. | |
| 8,647,470 | B2 | 2/2014 | Esser | |
| 8,835,141 | B2 | 9/2014 | Zhu et al. | |
| 9,029,275 | B2 | 5/2015 | Yana et al. | |
| 9,181,653 | B2 | 11/2015 | Paltakari et al. | |
| 9,267,237 | B2 | 2/2016 | Hentze et al. | |
| 9,322,133 | B2 * | 4/2016 | Nelson | C08B 15/08 |
| 9,816,230 | B2 * | 11/2017 | Haldane | D21C 9/005 |
| 2007/0207692 | A1 | 9/2007 | Ono et al. | |
| 2008/0060774 | A1 | 3/2008 | Zuraw et al. | |
| 2009/0264036 | A1 | 10/2009 | Yana et al. | |
| 2010/0065236 | A1 | 3/2010 | Henriksson et al. | |
| 2012/0094953 | A1 | 4/2012 | Gane et al. | |
| 2012/0132380 | A1 | 5/2012 | Hentze et al. | |
| 2012/0132381 | A1 | 5/2012 | Hentze et al. | |
| 2012/0132383 | A1 | 5/2012 | Laine et al. | |

(Continued)

FOREIGN PATENT DOCUMENTS

| | | | |
|---|---|---|---|
| JP | 2005060680 | A | 3/2005 |
| WO | WO2011055017 | A1 | 5/2011 |

OTHER PUBLICATIONS

Siro et al., "Microfibrillated cellulose and new nanocomposite materials: a review" 2010, Cellulose 17: 459-494.

Rebouillat et al., "State of the Art Manufacturing and Engineering of Nanocellulose: A Review of Available Data and Industrial Applications," 2013, Journal of Biomaterials and Nanotechnology, 4:165-188.

Henriksson et al., "New nanocomposite concept based on crosslinking of hyperbranched polymers in cellulose nanopaper templates," Composites Science and Technology, 2010, pp. 1-18.

Henriksson et al., "Cellulose Nanopaper Structures of High Toughness," 2008, Biomacromolecules, 9:1579-1585.

*Primary Examiner* — Jose A Fortuna

(74) *Attorney, Agent, or Firm* — American Patent Agency PC; Daniar Hussain; Xiaomeng Shi

(57) ABSTRACT

A hydrated, nonwoven nanocellulose sheet and method for manufacturing the nanocellulose sheet are disclosed. The method of manufacture comprises the steps of diluting a purified nanocellulose slurry to form a colloidal nanocellulose suspension, dispersing pure nanocellulose crystals into the nanocellulose suspension in a nanocellulose crystal to total nanocellulose ratio less than 50% weight per weight (w/w), placing the suspension over a filter sheet in a dispensing device, and forming the hydrated, nonwoven nanocellulose sheet by filtering with a pressure difference across the filter sheet, via a high pressure or vacuum filtration process. The hydrated, nonwoven nanocellulose sheet thus manufactured has high conformability, drape-ability, good adhesion to the skin, and a high rate of evaporation, making it ideal for dermatological treatments.

20 Claims, 12 Drawing Sheets

(56) References Cited

U.S. PATENT DOCUMENTS

2012/0205065 A1 8/2012 Esser et al.
2012/0241114 A1 9/2012 Axrup et al.
2012/0291974 A1 11/2012 Kajanto
2012/0316330 A1* 12/2012 Zhu ..... B82Y 40/00 536/56
2013/0000855 A1* 1/2013 Nuopponen ..... D21H 11/18 162/76
2013/0017394 A1* 1/2013 Hua ..... D21D 1/20 428/401
2013/0065026 A1 3/2013 Walther et al.
2013/0273350 A1 10/2013 Lee et al.
2014/0038275 A1 2/2014 Gatenholm
2014/0058077 A1 2/2014 Laukkanen et al.
2014/0155301 A1 6/2014 Nelson et al.
2014/0186576 A1 7/2014 Harmer et al.
2014/0272352 A1* 9/2014 Tilton ..... D21H 5/12 428/215
2015/0017432 A1 1/2015 Shoseyov et al.
2015/0114581 A1 4/2015 Kinnunen et al.
2015/0299955 A1* 10/2015 Laukkanen ..... C08B 15/00 162/9
2015/0315747 A1 11/2015 Heiskanen et al.
2015/0315748 A1 11/2015 Imppola et al.
2016/0024718 A1 1/2016 Lee et al.
2016/0032531 A1 2/2016 Husband et al.
2016/0060815 A1 3/2016 Heiskanen et al.
2016/0176989 A1* 6/2016 Laukkanen ..... C08B 15/04 162/157.6
2016/0186377 A1* 6/2016 Haldane ..... D04H 1/4382 162/184
2016/0326697 A1* 11/2016 Retsina ..... D21H 11/18
2016/0369078 A1* 12/2016 Lapidot ..... C08B 15/08
2017/0027168 A1* 2/2017 Heath ..... A01N 25/30
2017/0204304 A1* 7/2017 Yu ..... D21H 27/002
2017/0204567 A1* 7/2017 Yu ..... D21H 27/002
2017/0210827 A1* 7/2017 Nelson ..... C08B 15/08
2017/0226692 A1* 8/2017 Zhu ..... D21B 1/021
2017/0240792 A1* 8/2017 Monclin ..... C09K 8/32
2017/0306055 A1* 10/2017 Fan ..... C08B 15/02
2018/0044856 A1* 2/2018 Dhumpa ..... D21H 11/18

* cited by examiner

MANUFACTURE OF HYDRATED NANOCELLULOSE SHEETS FOR USE AS A DERMATOLOGICAL TREATMENT

REFERENCE TO RELATED APPLICATIONS

This application is a Continuation-In-Part (CIP) of and claims the benefit of priority to U.S. Ser. No. 14/986,578, filed on 31 Dec. 2015, now U.S. Pat. No. 9,816,230, entitled "Formation of Hydrated Nanocellulose Sheets With or Without a Binder for the Use as a Dermatological Treatment," which itself a non-provisional of provisional U.S. Ser. No. 62/098,627, filed on 31 Dec. 2014, entitled "Formation of Hydrated Nanocellulose Sheets With or Without a Binder for the Use as a Dermatological Treatment," the entire disclosures of both of which are incorporated by reference in their entireties herein.

FIELD OF THE INVENTION

Embodiments of the present invention relate to the manufacture of dermatological treatment products, and pertain particularly to methods and systems for forming hydrated, nonwoven nanocellulose sheets for use as a dermatological treatment.

BACKGROUND OF THE INVENTION

Nanocellulose, or nano-structured cellulose, comprises cellulose particles or fibers which have been exfoliated from cellulose fibrils using either mechanical or chemical means. The "nano" portion indicates that at least one dimension is measured in nanometers. This is in contrast with other fibers having similar geometry that are formed by dissolving the cellulose and regenerating it. Nanocellulose materials can be derived from wood, algae, plant or bacterial sources.

Due to its relative strength, especially in terms of strength/weight ratio, viscosity, and other mechanical properties, nanocellulose can be used for many applications. Some of the applications for nanocellulose include fillers for food products, paper towels or other paper products that benefit from increased absorbency, reinforcing plastics, medical and pharmaceutical applications, as well as multiple other applications.

Similar to nanocellulose, hydrogels of alginate, starch, polymers or cellulose can hold a significant amount of water. Hydrogels are cross-linked polymers which are well known in the art to hold large amount of water. For this reason, hydrogels are often used in situations where it is important to maintain a certain level of saturation and/or absorption. One application of hydrogels is for a dermatological mask, where hydrogels' water retention capacity, coupled with or without the inclusion of dermatological agents, enables the application of a saturated hydrogel mask to a user's skin. Unfortunately, such masks have a low degree of conformability to the skin and are not porous. The lack of porosity limits the absorption of dermatologically active ingredients by the skin.

In addition to cross-linked alginates, nonwoven sheets with dermatologically active ingredients may be used for dermatological masks as well. Such nonwoven sheets are usually made from long fibers bonded together using chemical, mechanical, heat, or solvent treatments. A flat, porous sheet is typically formed using this method. Nonetheless, conventional systems are not optimized for efficient production of nonwoven sheets with even dispersion of active ingredients or controlled formation of porous sites.

Therefore, in view of the aforementioned difficulties, there is an unsolved need for methods and systems for efficient production of hydrated, nonwoven dermatological sheets capable of transpiring or evaporating water through, thereby causing a dynamic fluid system between the skin beneath the sheet and the sheet itself. In addition, it would be an advancement in the state of the art to incorporate particulates and solution-based active ingredients for even dispersion throughout the formed sheets.

It is against this background that various embodiments of the present invention were developed.

BRIEF SUMMARY OF THE INVENTION

A method is provided for manufacturing hydrated, nonwoven nanocellulose sheets, using a high pressure or vacuum filtration process from a diluted nanocellulose suspension.

More specifically, in one aspect, one embodiment of the present invention is a method of manufacture for forming a hydrated, nonwoven nanocellulose sheet, the method comprising the steps of: providing a purified nanocellulose slurry; forming a colloidal nanocellulose suspension by diluting the nanocellulose slurry with a suspension medium; dispersing pure nanocellulose crystals into the nanocellulose suspension in a nanocellulose crystal to total nanocellulose ratio below 50%, weight per weight (w/w); placing the nanocellulose suspension over a filter sheet in a dispensing device; and forming the hydrated, nonwoven nanocellulose sheet by filtering the nanocellulose suspension with a pressure difference across the filter sheet.

In some embodiments, the nanocellulose slurry comprises at least one of nanocellulose fibrils or nanocellulose crystals. In some embodiments, the nanocellulose suspension has a nanocellulose concentration between 0.010% to 1% by weight;

In some embodiments, the method further comprises drying the nanocellulose sheet to a water content between 300% to 700% of nanocellulose weight, wherein the nanocellulose crystal to total nanocellulose ratio is between 0.001 to 10%.

In some embodiments, the method further comprises adding a pure nanocellulose crystal suspension in crystal weight percent composition between 0.001% and 10% to a surface of the hydrated, nonwoven nanocellulose sheet.

In some embodiments, the suspension medium is oil-based. In some embodiments, the method further comprises adding a polyelectrolyte to the suspension in a polyelectrolyte to total nanocellulose ratio between 0.01% to 84% weight per weight (w/w) as a flocculation agent.

In another aspect, one embodiment of the present invention is a method of manufacture for forming a hydrated, nonwoven nanocellulose sheet, the method comprising the steps of: providing a purified nanocellulose slurry; forming a colloidal nanocellulose suspension by diluting the nanocellulose slurry with a suspension medium; adjusting a pH value of the nanocellulose suspension to above 12.4; dissolving a polyelectrolyte in the pH-adjusted suspension, wherein an ionic charge of the polyelectrolyte is an integer multiple of a nanocellulose backbone charge of the suspension; placing the nanocellulose suspension over a filter sheet in a dispensing device; and forming the hydrated, nonwoven nanocellulose sheet by filtering the nanocellulose suspension with a pressure difference across the filter sheet.

In some embodiments, the adjusting of the pH value is by adding 1.0M NaOH to increase the pH value, or adding 1.0M HCl to decrease the pH value. In some embodiments, the integer multiple is between 1 and 6 inclusive.

In some embodiments, the method further comprises stirring the suspension after the dissolving of the polyelectrolyte to form polyelectrolyte complex networks, wherein a viscosity of the suspension is between 0.890 centipoise (cP) inclusive and 500,000 centipoise (cP) inclusive. In some embodiments, the viscosity of the suspension is between 1 centipoise (cP) and 500 cP.

In some embodiments, the method further comprises adding a polyelectrolyte to a surface of the nanocellulose sheet in a total polyelectrolyte to total nanocellulose ratio between 0.01% to 84% weight per weight (w/w).

In some embodiments, the method further comprises adding an amount of a dermatologically active ingredient to the nanocellulose suspension, after the dissolving of the polyelectrolyte.

In a third aspect, one embodiment of the present invention is a method of manufacture for forming a hydrated, nonwoven nanocellulose sheet, the method comprising the steps of: providing a purified nanocellulose slurry; forming a colloidal nanocellulose suspension by diluting the nanocellulose slurry with a suspension medium; adding a first binding agent into the nanocellulose suspension; adding a cross-linking agent into the nanocellulose suspension; placing the nanocellulose suspension over a filter sheet in a dispensing device; and forming the hydrated, nonwoven nanocellulose sheet by filtering the nanocellulose suspension with a pressure difference across the filter sheet.

In some embodiments, a mass concentration of the binding agent in the nanocellulose suspension is between 0.001 grams per liter to 10 grams per liter. In some embodiments, a mass concentration of the cross-linking agent in the nanocellulose suspension is between 0.001 grams per liter to 20 grams per liter.

In some embodiments, the method further comprises adding a second binding agent to a surface of the nanocellulose sheet in a second binding agent to total nanocellulose ratio between 0.001% to 10% weight per weight (w/w).

In some embodiments, the method further comprises adding a hydrophilic pore former to the nanocellulose suspension, wherein a pore former to total nanocellulose ratio is between 5% and 75% weight per weight (w/w).

In some embodiments, the method further comprises adding a hydrophilic pore former to a surface of the hydrated, nonwoven nanocellulose sheet, wherein a pore former to total nanocellulose ratio is between 5% and 75% weight per weight (w/w).

Yet other aspects of the present invention include methods, processes, and algorithms comprising the steps described herein, and also include the processes and modes of operation of the systems and devices described herein. Other aspects and embodiments of the present invention will become apparent from the detailed description of the invention when read in conjunction with the attached drawings.

BRIEF DESCRIPTION OF THE DRAWINGS

Embodiments of the present invention described herein are exemplary, and not restrictive. Embodiments will now be described, by way of examples, with reference to the accompanying drawings. For purposes of clarity, not every component is labeled in every drawing. The drawings are not drawn to scale, with emphasis instead being placed on illustrating various aspects of the techniques and devices described herein.

DETAILED DESCRIPTION OF THE INVENTION

Figure 1:
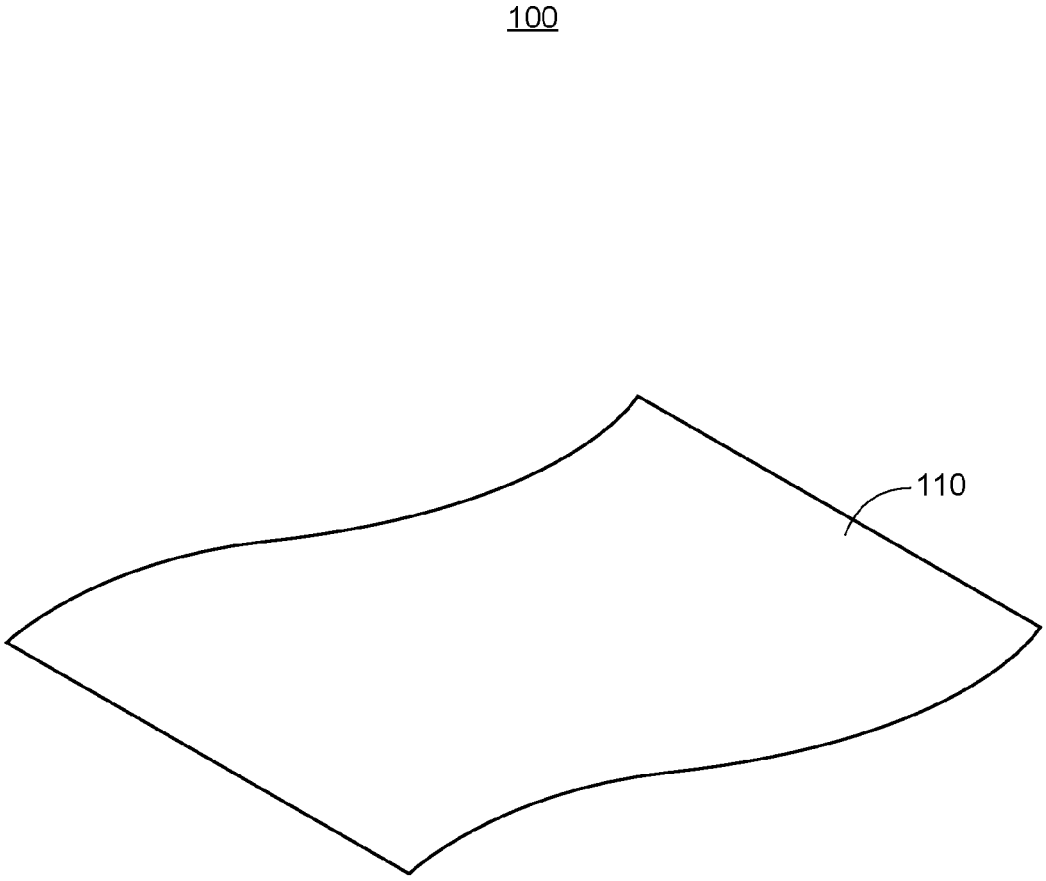
FIG. 1 is a perspective view of a nanocellulose sheet manufactured according to one embodiment of the present invention.

In the following description, for purposes of explanation, numerous specific details are set forth in order to provide a thorough understanding of the invention. It will be apparent, however, to one skilled in the art that the invention can be practiced without these specific details. In other instances, structures, devices, activities, methods, and processes are shown using schematics, use cases, and/or diagrams in order to avoid obscuring the invention. Although the following description contains many specifics for the purposes of illustration, anyone skilled in the art will appreciate that many variations and/or alterations to suggested details are within the scope of the present invention. Similarly, although many of the features of the present invention are described in terms of each other, or in conjunction with each other, one skilled in the art will appreciate that many of these features can be provided independently of other features. Accordingly, this description of the invention is set forth without any loss of generality to, and without imposing limitations upon, the invention.

Overview

Broadly, embodiments of the present invention relate to a hydrated, nonwoven nanocellulose sheet, and methods and systems for manufacturing the nanocellulose sheet. The hydrated, nanocellulose sheet is formed through a pressured filtration process from a diluted nanocellulose suspension. Various additives may be dissolved or dispensed into the diluted nanocellulose suspension in controlled steps or sequences. Such additives include, but are not limited to, binding agents, cross-linking agents, dermatologically active ingredients, morphology-altering particles, base material modifiers, pure nanocellulose crystals, polyelectrolytes, and pH modifying solutions. Binding agents added to the nanocellulose suspension improve the strength of the nonwoven nanocellulose sheet. Such binding agents may alternatively be "activated" or cross-linked after the formation of the sheet by applying other chemical agents or treating the sheet after formation. Similarly, additive ingredients as listed above may be applied to the sheet after formation of the nanocellulose sheet, via mechanisms such as spraying, dipping, soaking, and the like.

The elements and process of manufacturing the hydrated, nonwoven nanocellulose sheet produce several advantageous properties, include high conformability, drape-ability, large surface area, good levels of adhesion to the skin of a user, ability to contain and effectively deliver nano and micro particles, high porosity, and high rate of evaporation of water from the sheet. These properties make the nanocellulose sheet ideal for resting against the skin of a user and delivering dermatological agents which are generally difficult to do or which require multi-step processes to be delivered to the skin.

Furthermore, some embodiments of the present invention introduce pure nanocellulose crystals into the nanocellulose sheet production process, which increases the overall strength of the sheet produced, making it less likely to tear, while reducing the sheet drying time. Conventionally, high levels of hydration are desirable and crystals are not used in nanocellulose sheet production because they do not swell in the presence of an aqueous solution. Embodiments of the present invention carefully balances the use of nanocellulose crystals and nanocellulose fibers to achieve desired hydration levels while enhancing sheet durability and tensile strength, and reducing overall processing times.

Moreover, a novel polyelectrolyte addition process during nanocellulose sheet production is disclosed herein to allow the porosity and extrinsic charge sites within the formed sheets to be tuned by varying a ratio of the polyelectrolyte to the nanocellulose. Polyelectrolytes have been frequently used to form multilayers and free standing thin films. Unlike traditional polyelectrolyte complexes where a solid precipitate is formed, such as between Polystyrene Sulfonate (PSS) and poly(diallyldimethylammonium chloride) (PDADMAC), in embodiments of the present invention, polyelectrolytes act as a scaffold and ion exchange sites, bind to the nanocellulose upon filtration without forming any solid precipitates.

Dermatological Applications of Nanocellulose Sheets

FIG. 1 shows a perspective view 100 of a hydrated, nonwoven nanocellulose sheet 110 manufactured according to one embodiment of the present invention. In the present disclosure, nanocellulose refers to nano-structured cellulose, and may be cellulose nanofibers, cellulose nanocrystals, or the combination of both. Cellulose nanofibers (CNF) are also called cellulose nanofibrils, nanocellulose fibrils, nanocellulose fibers or microfibrillated cellulose; cellulose nanocrystals (CNC) are also called nanocellulose crystals or nanocrystalline cellulose. The "nano" portion indicates that at least one dimension of a cellulose particle is measured in nanometers or in the nanometer scale. Nanocellulose materials may be exfoliated from cellulose fibrils via mechanical or chemical processes, and may be derived from many sources including bacteria, plant, wood, algae and even fruit waste. For example, in some embodiments, the nanocellulose is extracted from wood pulp cellulose. Pre-treatments may be used, such as TEMPO-mediated oxidation, and the sheet 110 may be formed by using TEMPO-oxidized nanocellulose.

In some embodiments, sheet 110 may be cut into different forms, including different shapes, sizes or configurations that facilitate direct application to the skin. The different shapes and sizes may be used for different skin-contact applications on different parts of a user's body. Exemplary applications include, but are not limited to, wound healing, dermatology, and cosmetology. FIGS. 2A to 2D and corresponding discussions below illustrate exemplary shapes that may be cut from nanocellulose sheet 110. The following discussion should not, however, limit the scope of the applications of the invention.

Figure 2A:
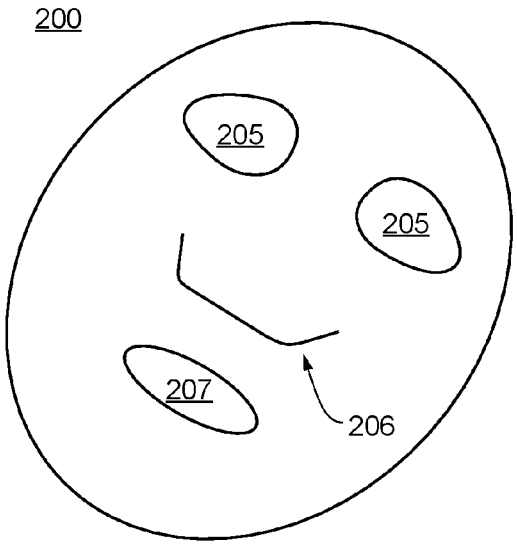
FIG. 2A is a perspective view of a facial mask cut from a nanocellulose sheet manufactured according to one embodiment of the present invention.

FIG. 2A shows a facial mask 200 which may be cut from a nanocellulose sheet 110, according to one embodiment of the present invention. Mask 200 may be applied to a user's entire face, where holes 205 and 207 are cut around the eye and mouth areas, while a slit 206 is cut to allow breathing through the nose. As shall be discussed in further detail later, nanocellulose sheet 110 as disclosed herein is highly conformable and drapable, with a good level of adhesion to the skin. Such advantageous properties allow facial mask 200 to conform to the facial contour, enabling full coverage of all exposed facial skins. In addition, facial mask 200 may provide an even dispersion of dermatologically active ingredients, while allowing fast transpiration or evaporation of water through the sheet, leading to a dynamic fluid and nutrient delivery system between the sheet and the skin beneath the sheet. The dermatologically active ingredients may be particulate or solution-based, and may provide medicated or nutritional supplements to the skin.

Figure 2B:
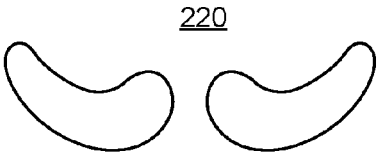
FIG. 2B is a perspective view of eye masks cut from a nanocellulose sheet manufactured according to one embodiment of the present invention.
Figure 2C:
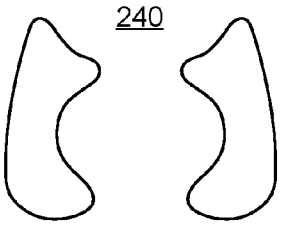
FIG. 2C is a perspective view of side facial masks cut from a nanocellulose sheet manufactured according to one embodiment of the present invention.
Figure 2D:
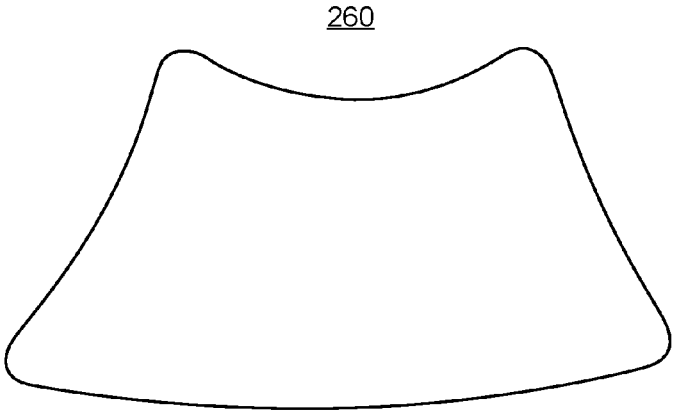
FIG. 2D is a perspective view of a neck mask cut from a nanocellulose sheet manufactured according to one embodiment of the present invention.

FIGS. 2B, 2C, and 2D show a pair of under eye masks 220, a pair of side facial masks 240, and a neck mask 260 respectively, each may be cut from nanocellulose sheet 110, according to some embodiments of the present invention. As shown in FIG. 2B, each under eye mask may be cut in a shape that fits under the eye of a user. Similarly, side facial masks 240 may be applied to sides of a user's mouth, nose, eyes, temples, cheeks, jaws, or any other locations on a user's face. Neck mask 260 may be wrapped around the neck of a user. Similarly, shoulder masks, back masks, thigh masks, and masks of other shapes may be cut from nanocellulose sheet 110 in any desirable form, including shape, size, and configuration.

As disclosed herein, hydrated, nonwoven nanocellulose sheets produced according to embodiments of the present invention may incorporate dermatologically active ingredients to enhance the effects of applying a hydrated sheet mask. To produce a nanocellulose sheet such as 110, a series of steps may be carried out.

Nanocellulose Sheet Production

Figure 3:
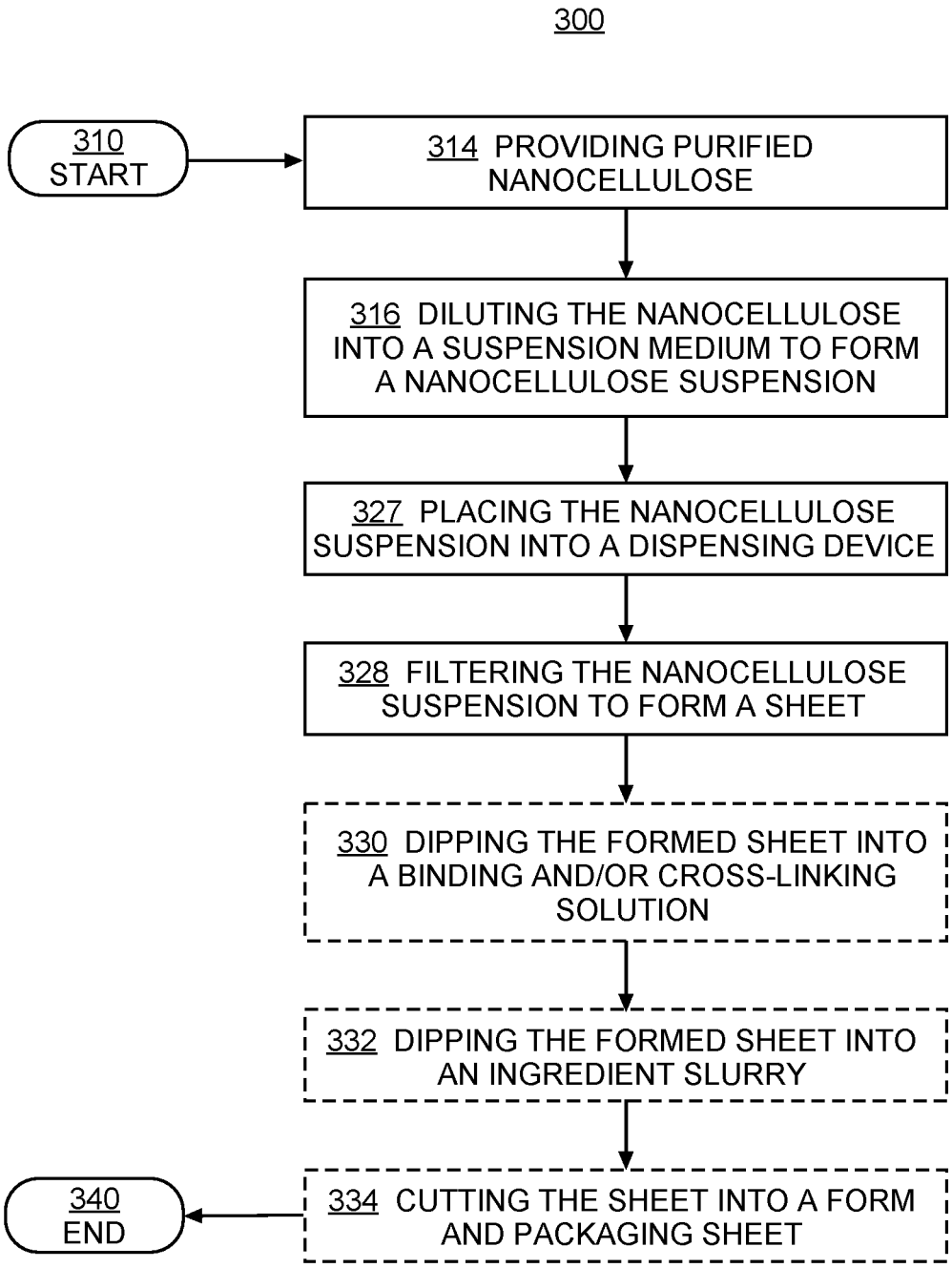
FIG. 3 is an illustrative flow diagram showing steps of manufacturing a nanocellulose sheet, according to one embodiment of the present invention.

FIG. 3 is an illustrative flow diagram 300 showing steps of manufacturing a nanocellulose sheet, according to one embodiment of the present invention. Upon initialization at step 310, a purified nanocellulose material is first provided at step 314. Such a nanocellulose material may comprise nanocellulose fibers, nanocellulose crystals, or a combination of both in a controlled proportion. Embodiments of the present invention may utilize nanocellulose having any diameter and length. For example, the nanocellulose may have a diameter of 5 to 100 nm and length of up to 10 microns.

At step 316, the nanocellulose is diluted into a suspension medium to form a nanocellulose suspension. In some embodiments, the nanocellulose is diluted to a mass concentration between 0.01 gram per liter to 10 grams per liter. In some embodiments, the nanocellulose is diluted to a mass concentration between 0.1 gram per liter to 10 grams per liter. In some embodiments, the nanocellulose is diluted with a suspension medium capable of being combined with the cellulose to form a stable suspension. Exemplary suspension media include, but are not limited to, water, alcohols, or oil. In some embodiments, an oil-based suspension medium may further comprise a surfactant.

The dilution of nanocellulose into a suspension and subsequent usage of such a nanocellulose suspension in sheet production is beneficial as they allow nanocellulose material to be accepted from multiple sources. For example, grown pellicles of nanocellulose are commonly obtained in bacterially grown cellulose. In some embodiments, the nanocellulose material may be pre-treated before nanocellulose formation from cellulose fibers. Such pre-treatments may include mechanical or enzymatic treatment of a cellulose containing material. For example, cellulose containing material may be oxidized using 2,2,6,6-tetramethylpiperidin-1-oxyl radical ("TEMPO"), which introduces charged groups. Carboxymethylation may also be used to pre-treat the cellulose containing material. Finally, acid hydrolysis may be used to treat the cellulose containing material.

Figure 8:
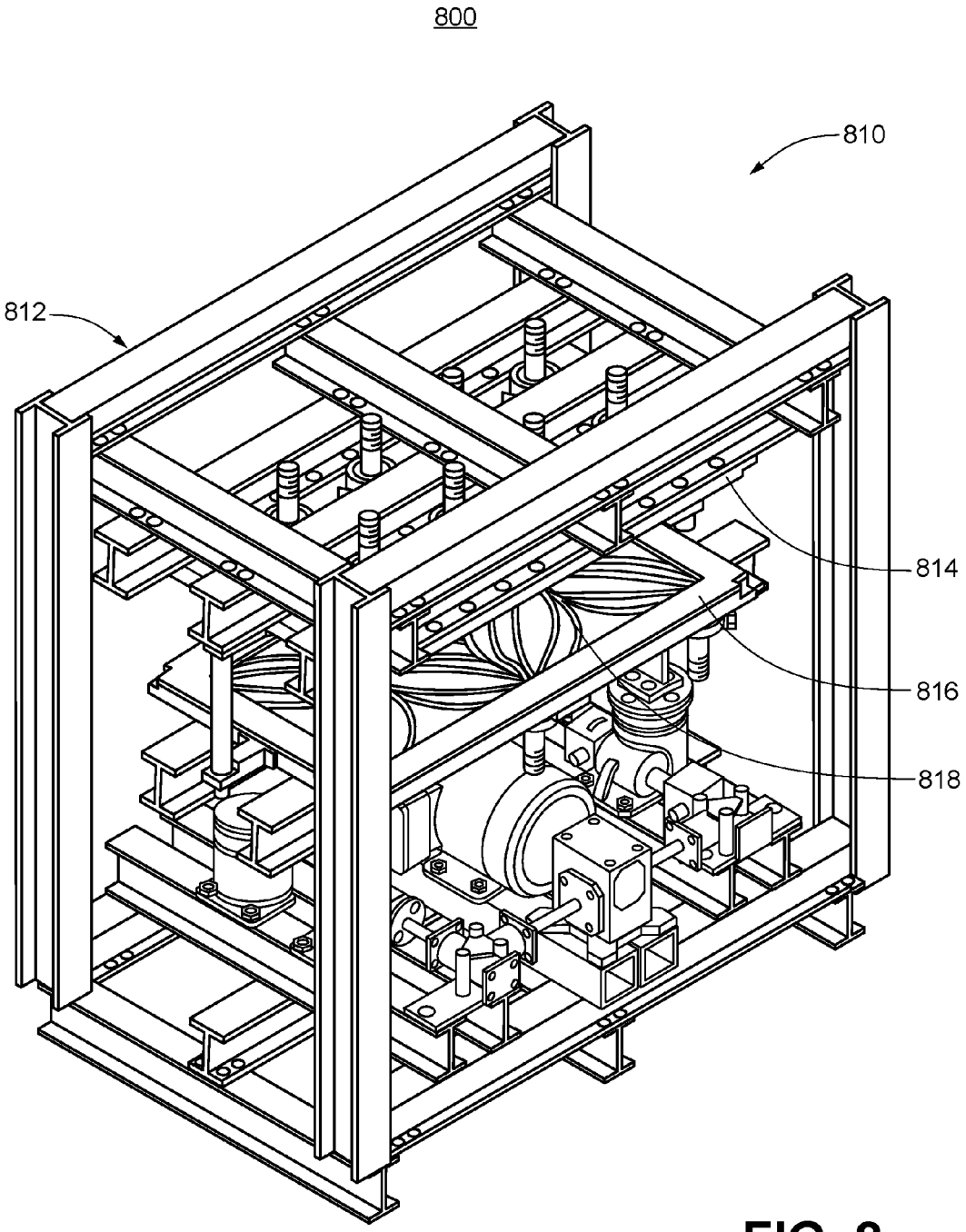
FIG. 8 is a perspective view of a dispensing device for forming a nanocellulose sheet, according to one embodiment of the present invention.

Next, at step 327, the nanocellulose suspension is placed into a dispensing device for a filtering or micro-filtration process, where the suspension is filtered at step 328 to form a nanocellulose sheet. The dispensing device may be a device capable of micro-filtration and/or fabricating sheets of nanomaterials, using positive pressure or vacuum across a filter medium such as a filter paper or filter membrane, to produce large, uniform-thickness sheets of nanomaterials of variable sizes, shapes, and thicknesses. An exemplary device that may be used in embodiments of the present invention and is discussed in more detail with reference to FIG. 8 is disclosed in U.S. application Ser. No. 14/186,795, the entire disclosure of which is incorporated by reference in its entireties herein. During the filtration process, the dispensing device may remove water from the suspension, leaving a hydrated but solid sheet. The solid sheet may be, in one example, 10-50% solids.

Other optional steps shown in FIG. 3 include dipping the formed sheet into a binding and/or a cross-linking solution at step 330, dipping the formed sheet into an ingredient slurry at step 332, and cutting the sheet into a desirable form, then packaging the sheet at step 334. The nanocellulose sheet manufacturing process terminates at step 340. The dipping actions into different solutions or slurries, and cutting of the sheet may be performed in any order, after the sheet has been formed, but before it is packaged. In summary, in this embodiment, the aqueous solution of nanoscale particles does not require the use of binders, fillers or adhesives. Instead, reactive hydroxyl groups on the nanocellulose material readily hydrogen bond with one another to form a tight-knit network, yielding a highly stable nanocellulose sheet with low density, high surface area, and high biocompatibility. Binding agents and additive ingredients may be added after sheet formation.

In some embodiments, each of the binding and cross-linking solution may be prepared by diluting a binding agent or a cross-linking agent to suitable mass concentrations. For example, between 0.001 grams per liter to 100 grams per liter, 0.001 grams per liter to 10 grams per liter, 0.01 grams per liter to 10 grams per liter, or 0.01 grams per liter to 20 grams per liter. The nanocellulose sheet may be dipped into the binding solution only, the cross-linking solution only, or one solution after the other. Exemplary wet binding agent or gelling agents include sodium alginate, agar, any polycationic, such as polyamidoamine-epichlorohydrin or KYMENE, and any anionic such as carboxymethylcellulose or Hyaluronic acid. Sodium alginate is a negatively charged polymer that forms a hydrogel. Addition of sodium alginate helps retain water well against outside forces. Exemplary cross-linking agents include calcium lactate, calcium chloride, calcium stearate or oil, which may be capable of cross-linking or "setting" the binding agent, where relevant. Moreover, although a "dipping" action is referred to in steps 330 and 322, in some embodiments, similar operations such as spraying, soaking, and the like may be performed instead.

In this embodiment and other embodiments disclosed herein, the term "ingredient" or "additive ingredient" collectively refers to one or more of the following materials: particulate or solution-based dermatologically active ingredients, base material modifiers including pure nanocellulose crystals, morphology-altering particles, and other similar additives. One or more additive ingredients may be added to the nanocellulose suspension before the micro-filtration process, or may be added to the formed sheet after the micro-filtration process such as shown by step 332 in FIG. 3. Addition of additive ingredients after sheet formation distributes the ingredient over one or both surfaces of the formed sheet, allowing ingredient particles to interact with nanocellulose particles with available hydrogen-bonding sites. The addition process may be carried out via mechanisms such as spraying, dipping, soaking, and the like. Ingredients may be added for cosmetic or pharmaceutical purposes, for delivery to the skin of the user, or for modifying the properties of the formed sheet by enhancing its strength, durability, permeability, porosity, or water retention capability.

Many known particulate or solution-based materials may be used as additive ingredients. Exemplary dermatologically active ingredients include, but are not limited to, silver, collagen, proteins, fragrances or antioxidants such as blended green tea. Exemplary base material modifiers include, but are not limited to, other forms of cellulose fibers, other forms of nanofibers such as cellulose nanocrystals (CNC), nanoclay, extended release particles, microencapsulates, polyelectrolytes such as poly(diallyldimethylammonium chloride) (PDADMAC), and polyether such as Polyethylene glycol (PEG).

In general, when only nanocellulose fiber or 100% cellulose nanofibers (CNF) are diluted into a nanocellulose suspension, without additive ingredients, a hydrogen-bonded network of polymer chains is formed during sheet formation, capable of holding several times its mass in water. When this network interacts with external additives, the external additives inhibit the hydrogen bonding capabilities of the 100% CNF network, which causes a decrease in an extent of hydration (EOH). A decrease in EOH may be beneficial for a variety of applications that require shorter processing times and lower EOH values, such as cosmetic applications that need specific amounts of water with good durability.

As mentioned above, one additive ingredient may be CNC, which are crystalline regions of CNF. When added, CNC neither swell significantly, nor exhibits ⅔ of the available H-bonding sites, thus causing the manufactured nanocellulose sheet to hold less water.

Another additive ingredient may be a polyelectrolyte such as PDADMAC, which is a positively charged polymer that directly binds with negatively charged CNF, and significantly reduces EOH. By varying the proportion of PDADMAC to CNF, an extent of intrinsic ionic compensation may be tuned, reflecting how many charged groups from each chain interact with one another.

In FIG. 3, active ingredients are added after the filtering step 328. The filtering step may alternatively be called a filtration, micro-filtration, or sheet formation step. In some embodiments, ingredients may be added before full formation of the nanocellulose sheet, such as discussed with reference to FIGS. 5 to 7. The addition of ingredients to the nanocellulose suspension before the micro-filtration process allows interaction and binding of the added ingredients prior to full sheet formation. Nanocellulose is a biopolymer that possesses six reactive hydroxyl groups per repeat unit that can be derivatized to covalently append a wide range of biologically active modules for use in different application areas. These reactive hydroxyl groups readily hydrogen bond with one another forming a tight-knit network, and the ingredients bind closely to the nanocellulose fibers. The imbedding or absorption of ingredients before sheet formation enables even dispersion of the ingredients through the thickness of the nanocellulose sheet thus formed. A greater concentration of ingredients may also be attained than would be by simply allowing a formed sheet to absorb the ingredients, for example via spraying or dipping mechanisms.

Although not shown explicitly in FIG. 3, other optional steps to the nanocellulose sheet production process include collecting and re-dispersing of a gel formed from the nanocellulose suspension in a solution and forming a second nanocellulose suspension by mixing or blending, filtration of the original nanocellulose suspension or the second nanocellulose suspension with positive pressure or vacuum to the filter paper, dewatering of the nanocellulose sheet to between 300% and 700% of water content in nanocellulose weight, addition of liquid active agents to the formed nanocellulose sheet, and packaging of the form sheets in gas impermeable packages.

A hydrated, nonwoven nanocellulose sheet manufactured according to embodiments of the present invention have high conformability and drape-ability, a high surface area, a good level of adhesion to the skin, the ability to trap nano and micro particles, high porosity, and a high rate of evaporation of water from the sheet. Conformability, drape-ability, high surface area and adhesion to the skin are characteristics that make the nanocellulose sheet ideal for lying against the skin. The ability to contain nano and micro particles, as well as absorbing aqueous solutions, make the material ideal as a delivery mechanism for dermatological agents that are known to be difficult to deliver, or require multi-step processes to deliver to the skin. Thus, a hydrated, nonwoven nanocellulose sheets such as 110, 200, 220, 240, or 260 are capable of delivering dermatological agents or other ingredients more effectively and for a longer period of time than conventional sheet masks.

Figure 4:
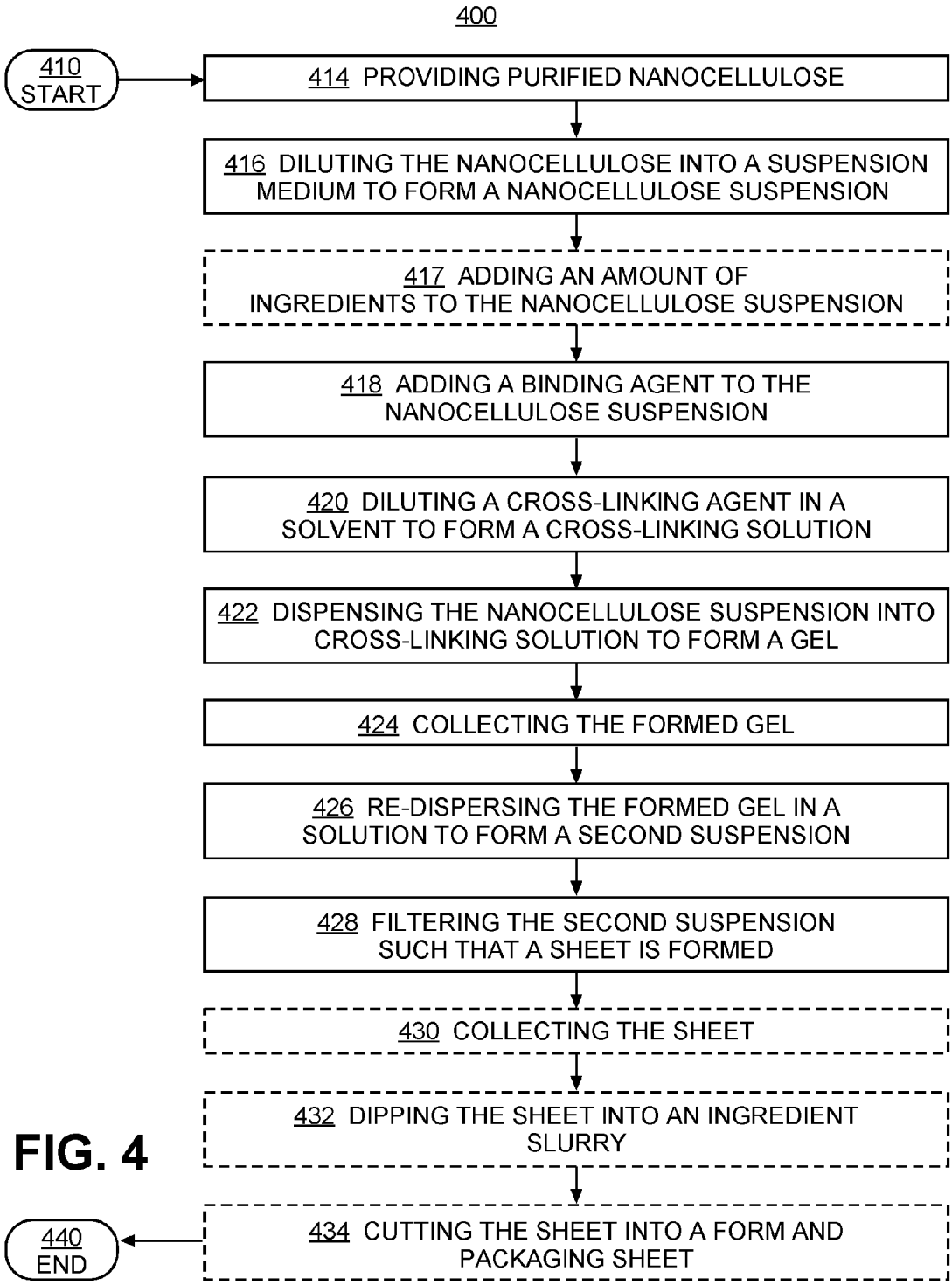
FIG. 4 is an illustrative flow diagram showing steps of manufacturing a nanocellulose sheet when gel collection is performed, according to one embodiment of the present invention.

FIG. 4 is an illustrative flow diagram 400 showing steps of manufacturing a nanocellulose sheet when gel collection is performed, according to one embodiment of the present invention. In this embodiment, binding agents and cross-linking agents are added to the nanocellulose suspension before full sheet formation, and an additional gel collection step is performed.

More specifically, similar to the process shown in FIG. 3, upon initialization at step 410, a purified nanocellulose material is first provided at step 414, where the nanocellulose material may comprise one or both of nanocellulose fibers and nanocellulose crystals. Next, at step 416, the nanocellulose is diluted into a suspension medium to form a nanocellulose suspension. Similar to the process shown in FIG. 3, in some embodiments, the nanocellulose is diluted to a mass concentration between 0.01 gram per liter to 10 grams per liter, or alternatively between 0.1 gram per liter to 10 grams per liter. At above 10 grams per liter, dewatering of the fully formed sheet to a desired water content becomes difficult. In various embodiments, the nanocellulose may be diluted with any suspension medium capable of being combined with the cellulose to form a stable suspension. Exemplary suspension media include, but are not limited to, water, alcohols or oil, which may further comprise a surfactant.

An optional step 417 may then be performed to add an amount of ingredients to the nanocellulose suspension. Different types of ingredients are previously discussed with reference FIG. 3.

Next, at step 418, a binding agent is added to the nanocellulose suspension. At step 420, a cross-linking agent is diluted in a solvent, such as water, to form a cross-linking solution. At step 422, the nanocellulose suspension is dispensed into the cross-linking solution to form a gel.

Similar to the embodiment illustrated by FIG. 3, the binding agent may be added to a mass concentration of various ranges in different embodiments, such as between 0.001 grams per liter to 100 grams per liter, or between 0.01 grams per liter to 10 grams per liter. Exemplary wet binding agent or gelling agents include sodium alginate or agar. The cross-linking solution may be prepared by diluting a cross-linking agent to any suitable mass concentrations. For example, between 0.001 grams per liter to 100 grams per liter, 0.001 grams per liter to 20 grams per liter, 0.01 grams per liter to 10 grams per liter, or 0.01 grams per liter to 20 grams per liter. The cross-linking solution may be prepared from calcium lactate, calcium chloride, calcium stearate or oil.

At step 424, the formed gel is collected from the mixture of the nanocellulose suspension and the cross-linking solution, and re-dispensed at step 426 into a solution to form a second nanocellulose suspension. The second nanocellulose suspension is then filtered at step 428 to form a nanocellulose sheet via positive or vacuum pressure.

Optionally, the sheet is collected at step 430, dipped into an ingredient slurry of liquid or solid additive ingredients at step 432, and cut into a desirable form and packaged at step 434.

In some embodiments, including when both steps 417 and 432 are performed in the process shown in FIG. 4, the incorporation of particulate or solution-based dermatologically active ingredients takes place both before and after the addition of a binding agent. As a result, additive ingredients are not only uniformly dispersed throughout the thickness of the nanocellulose sheet produced, but are also accepted in greater proportions than if only a single ingredient addition step is performed. Addition of additive ingredients after full sheet formation allows the ingredient molecules to interact and bond with available hydroxyl groups on the surface of the formed sheet. In some cases, a binding agent may be added to the fully formed sheet first, before other additive ingredients such as dermatologically active ingredients are added via spraying or dipping mechanisms. In some embodiments, different types of ingredients may be added in step 417, and 432 respectively, thus allowing one set of additive ingredients to be uniformly dispersed throughout the formed sheet, and another set of additive ingredients to pack more closely to the surface of the formed sheet. Such a design may be beneficial when ingredients of different release mechanisms are used.

Figure 5:
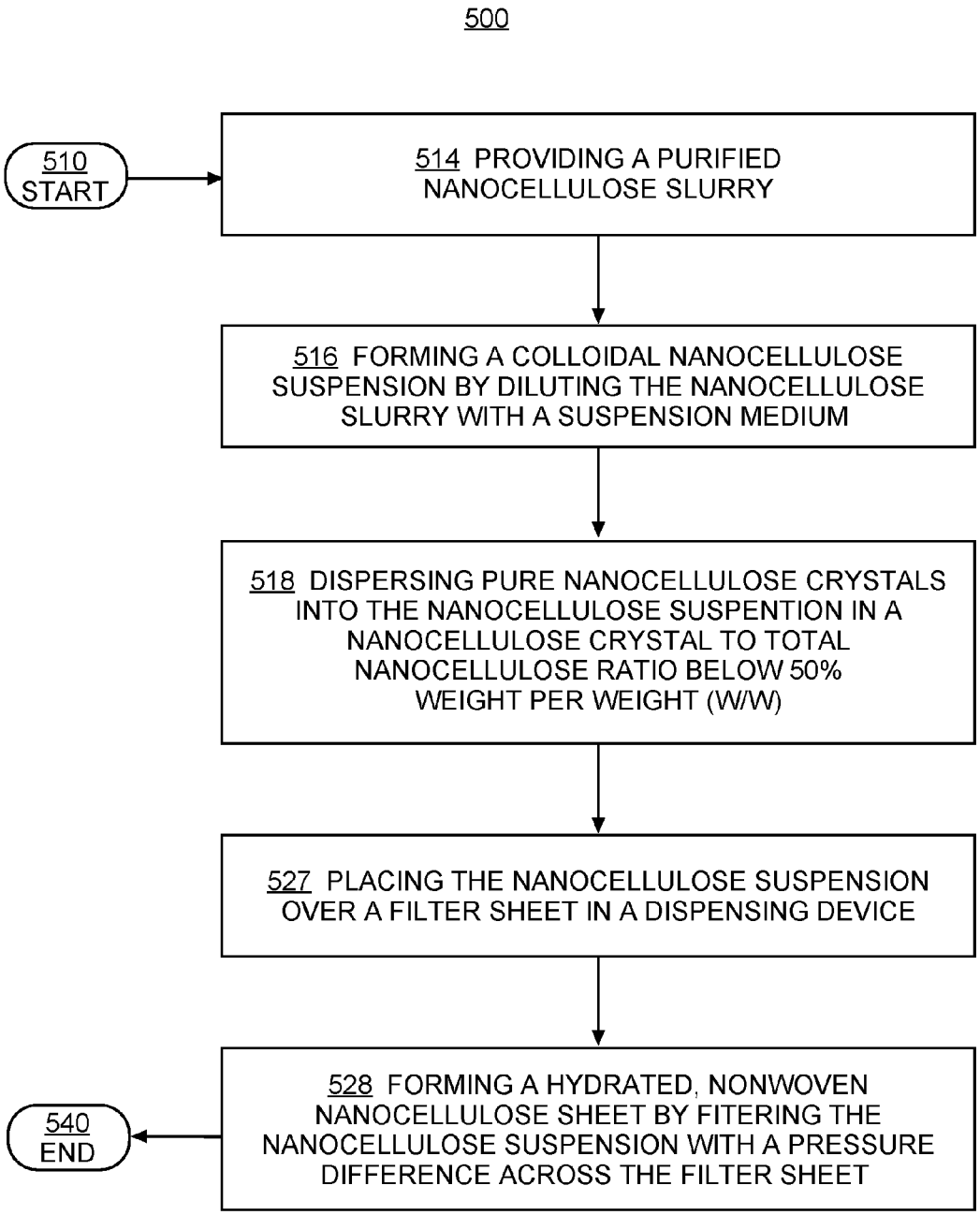
FIG. 5 is an illustrative flow diagram showing steps of manufacturing a nanocellulose sheet when pure nanocellulose crystals are added, according to one embodiment of the present invention.

FIG. 5 is another illustrative flow diagram 500 showing steps of manufacturing a nanocellulose sheet, when pure nanocellulose crystals are added, according to one embodiment of the present invention. Upon initiation at step 510, a purified nanocellulose slurry is provided at step 514. The nanocellulose slurry may have a solid content between 1% and 12%, and may comprise one or both of nanocellulose fibers and nanocellulose crystals. Next, at step 516, a colloidal nanocellulose suspension is formed by diluting the nanocellulose slurry with a suspension medium. In some embodiments, the nanocellulose suspension has a nanocellulose concentration between 0.010% to 1% by weight. In some embodiments, the nanocellulose suspension has a nanocellulose concentration between 0.001% to 1% by weight.

The suspension medium may be any suspension medium capable of being combined with the nanocellulose to form a stable suspension. Exemplary suspension media include, but are not limited to, water, alcohols or oil, which may further comprise a surfactant. In some embodiments, when the suspension medium is oil based, a polyelectrolyte may be further added to the suspension in a polyelectrolyte to total nanocellulose ratio between 0.01% to 84% weight per weight (w/w) as a flocculation agent.

Once a nanocellulose suspension is formed, one or more of a binding agent, a cross-linking agent, or one or more additive ingredients may be added to the nanocellulose suspension. As discussed previously, an additive ingredient may be a base modifier such as cellulose nanocrystals (CNC), polymers, polyelectrolytes, pore formers, or dermatologically active ingredients. These additives may be added, mixed, dispensed, dispersed, or dissolved into the nanocellulose suspension in any desired order and proportions, in different embodiments of the present invention. For example, dermatologically active ingredients may be added after a polyelectrolyte dissolution into the nanocellulose suspension.

In the embodiment shown in FIG. 5, at step 518, pure nanocellulose crystals are dispersed into the nanocellulose suspension in a nanocellulose crystal to total nanocellulose ratio below 50% weight per weight (w/w). That is, the ratio of the added pure nanocellulose crystals to the original nanocellulose solid content in the suspension is less than 1. Addition of the pure nanocellulose crystal inhibits the bonding of nanocellulose fibers to water, thus help reduce the drying time of a fully formed sheet to a desired water content. In some embodiments, the nanocellulose crystal to total nanocellulose ratio is between 0.1% and 50% w/w; in some embodiments, the nanocellulose crystal to total nanocellulose ratio is between 1% and 20% w/w; In some embodiments, the nanocellulose crystal to total nanocellulose ratio is between 0.1% and 10% w/w; In some embodiments, the nanocellulose crystal to total nanocellulose ratio is between 0.1% and 5% w/w.

At step 527, the nanocellulose suspension is placed over a filter sheet in a dispensing device, and a hydrated, non-woven nanocellulose sheet is fully formed at step 528 by filtering the nanocellulose suspension with a pressure difference across the filter sheet. The nanocellulose manufacture process terminates at step 540. Similar to the processes shown in FIGS. 3 and 4, the formed nanocellulose sheet may be collected from the dispensing device, optionally dipped, sprayed, or soaked in one or more ingredient solution or slurries, then cut and packaged. For example, one or both surfaces of the formed sheet may be sprayed with a hydrophilic pore former in where a pore former to total nanocellulose ratio is between 5% and 75% weight per weight (w/w), with a pure nanocellulose crystal suspension in crystal weight percent composition between 0.001% and 10%, or with a polyelectrolyte, in a polyelectrolyte to total nanocellulose ratio between 0.01% to 84% weight per weight (w/w).

Figure 6:
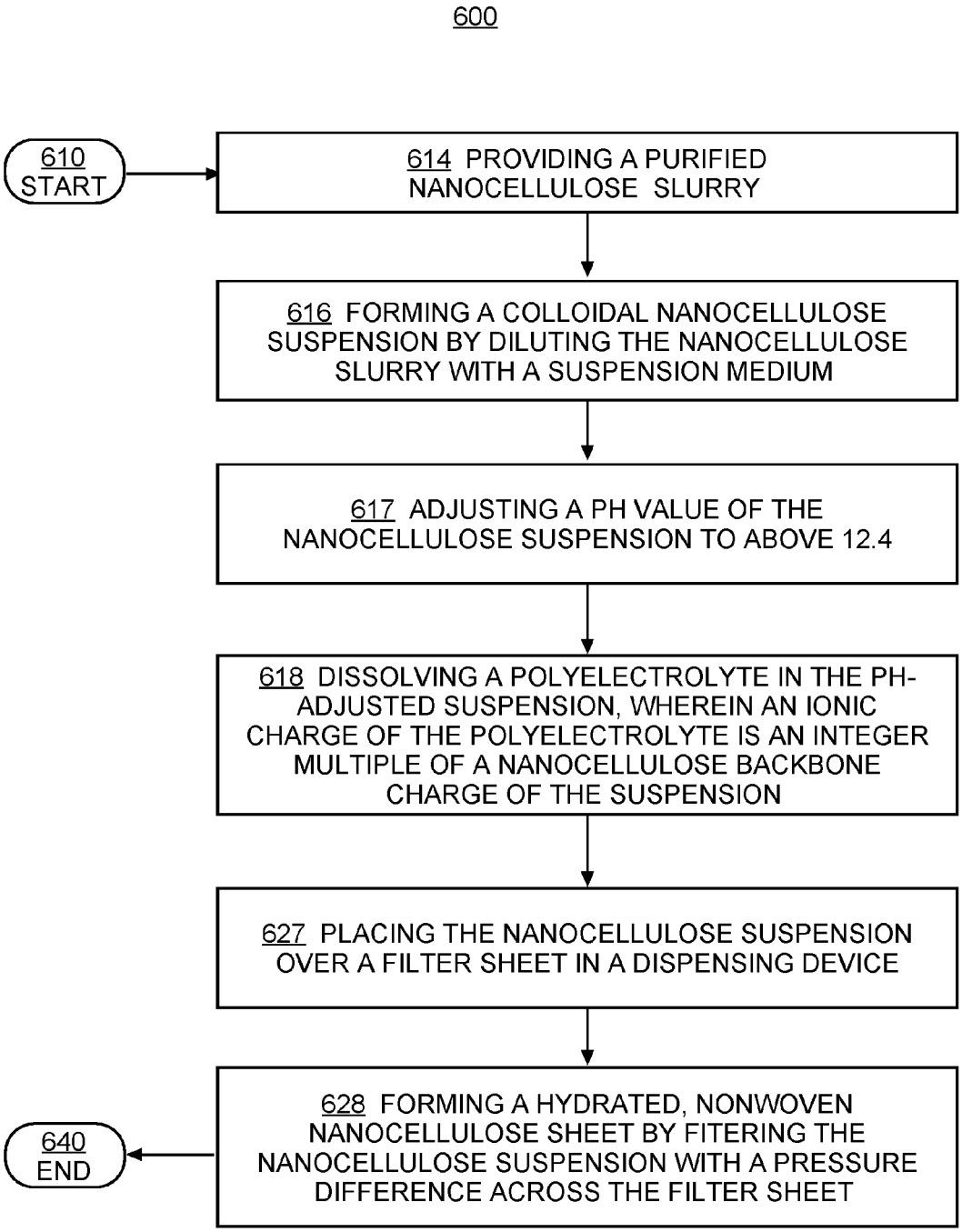
FIG. 6 is an illustrative flow diagram showing steps of manufacturing a nanocellulose sheet when polyelectrolytes are added, according to one embodiment of the present invention.

FIG. 6 is an illustrative flow diagram showing steps of manufacturing a nanocellulose sheet when polyelectrolytes are added, according to one embodiment of the present invention. Steps 610, 614, 616, 627, 628, and 640 are similar to steps 510, 514, 516, 527, 528, and 540 shown in FIG. 5. However, in this embodiment, polyelectrolytes are mixed in as an additive ingredient to the nanocellulose suspension before full sheet formation.

More specifically, polyelectrolytes are a base modifier material capable of tuning the porosity and extrinsic charge sites within the formed nanocellulose sheet, and helping avoid the use of cross-linking chemicals during sheet production. In this embodiment, at step 617, a pH value of an aqueous nanocellulose suspension may first be adjusted by the addition of acids or bases, to deprotonate hydroxyl groups and induce negative surface charges to create electrostatic binding sites, before polyelectrolytes are added to the pH-adjusted suspension at step 618, wherein an ionic charge of the polyelectrolytes is an integer multiple of a nanocellulose backbone charge of the suspension. For instance, pH may be adjusted up using 1.0 M NaOH and down using 1.0 M HCl. Total deprotonation occurs at a pH level of 12.5, while partial deprotonation occurs at a pH level of 8.5, and a target pH level may be set at 8.4. High pH values may result in the degradation of cellulose through the production of isosaccharinic acid, but only for long time scales, such as weeks or months. In addition, hydrolysis may be performed at a pH less than 3 to cleave glycosidic linkages between cellulosic units, which results in shorter CNF chains that are unlikely to bind to a polycation. Further stirring of the suspension after the dissolving of the polyelectrolyte may help form polyelectrolyte complex networks, wherein a viscosity of the suspension may be in controlled ranges, such as between 0.890 centipoise (cP) inclusive and 500,000 cP inclusive, between 0.890 cP inclusive and 1,000 cP inclusive, or between 1 cP inclusive and 500 cP inclusive.

In some embodiments, polyelectrolytes may be further added to one or both surfaces of the formed nanocellulose sheet in a total polyelectrolyte to total nanocellulose ratio between 0.01% to 84% weight per weight (w/w).

Figure 7:
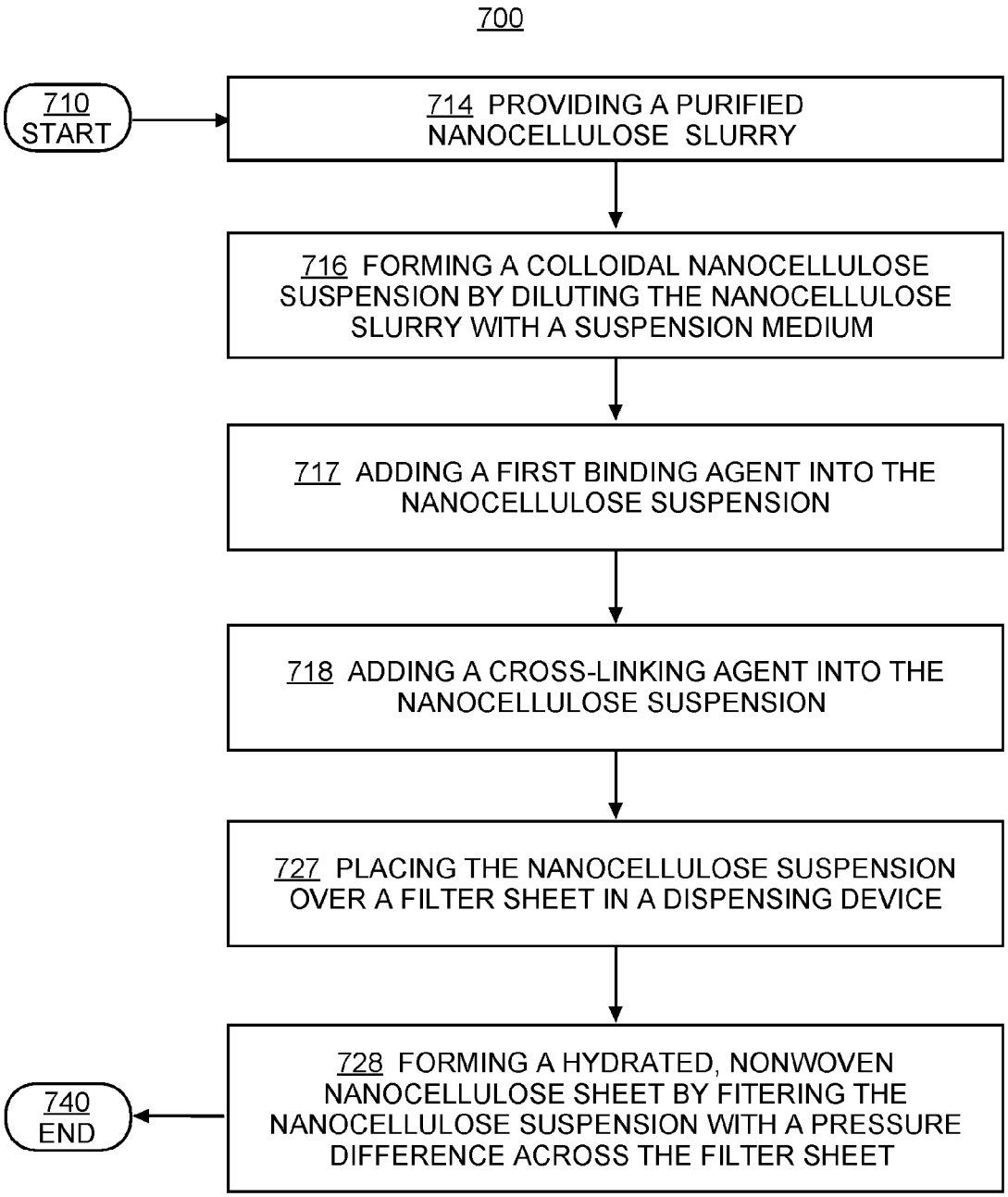
FIG. 7 is an illustrative flow diagram showing steps of manufacturing a nanocellulose sheet when binding and crossing-linking agents are added, according to one embodiment of the present invention.

FIG. 7 is an illustrative flow diagram showing steps of manufacturing a nanocellulose sheet when binding and crossing-linking agents are added, according to one embodiment of the present invention. Steps 710, 714, 716, 727, 728, and 740 are similar to steps 510, 514, 516, 527, 528, and 540 shown in FIG. 5. However, in this illustrative embodiment, binding agents and cross-linking agents are explicitly mixed in as an additive ingredient to the nanocellulose suspension before full sheet formation.

In particular, at step 717, a first binding agent is added into the nanocellulose suspension. At step 718, a cross-linking agent is added into the nanocellulose suspension. These two steps are interchangeable in order. Similar to the embodiment illustrated by FIG. 3, the binding agent may be added to the nanocellulose suspension to a mass concentration between 0.001 grams per liter to 10 grams per liter, 0.01 grams per liter to 10 grams per liter, 0.5 grams per liter to 50 grams per liter, or 5 grams per liter to 50 grams per liter; the cross-linking agent may be added to the nanocellulose suspension to a mass concentration between 0.001 grams per liter to 100 grams per liter, or 0.01 grams per liter to 20 grams per liter. Exemplary wet binding agent or gelling agents include sodium alginate, agar, any polycationic, such as polyamidoamine-epichlorohydrin or KYMENE, and any anionic such as carboxymethylcellulose or Hyaluronic acid. Exemplary cross-linking agents include calcium lactate, calcium chloride, calcium stearate or oil.

While not shown explicitly in FIG. 7, in some other embodiments, a hydrophilic pore former may be added before step 727 to the nanocellulose suspension, where a pore former to total nanocellulose ratio is between 5% and 75% weight to weight (w/w). In some embodiments, a hydrophilic pore formers solution may be added to one or both surfaces of the fully formed sheet, where a pore former to total nanocellulose ratio is between 5% and 75% weight to weight (w/w).

FIG. 8 is a perspective view 800 of a dispensing device or sheet former 810 for forming a nanocellulose sheet, according to one embodiment of the present invention. Dispensing device 810 is described in U.S. application Ser. No. 14/186,795, the entire disclosure of which is incorporated by reference in its entireties herein. In sheet former 810, various components are mounted on a frame 812, including a lower platen 816, and an upper platen 814. A filter media and gasket may be placed on lower platen 816, and the nanocellulose suspension may be placed, injected, or poured over the filter media, inside the gasket. A pressurized filtration envelope may be formed between the platens and the gasket when lower platen 816 is raised, or when upper platen 814 is lowered. Water may be removed from the nanocellulose suspension through a pressure difference across the filter media, and filtered effluent may be discharged or drained from the filtration envelop via drainage channels 818, leaving a hydrated but solid sheet.

Figure 9A:
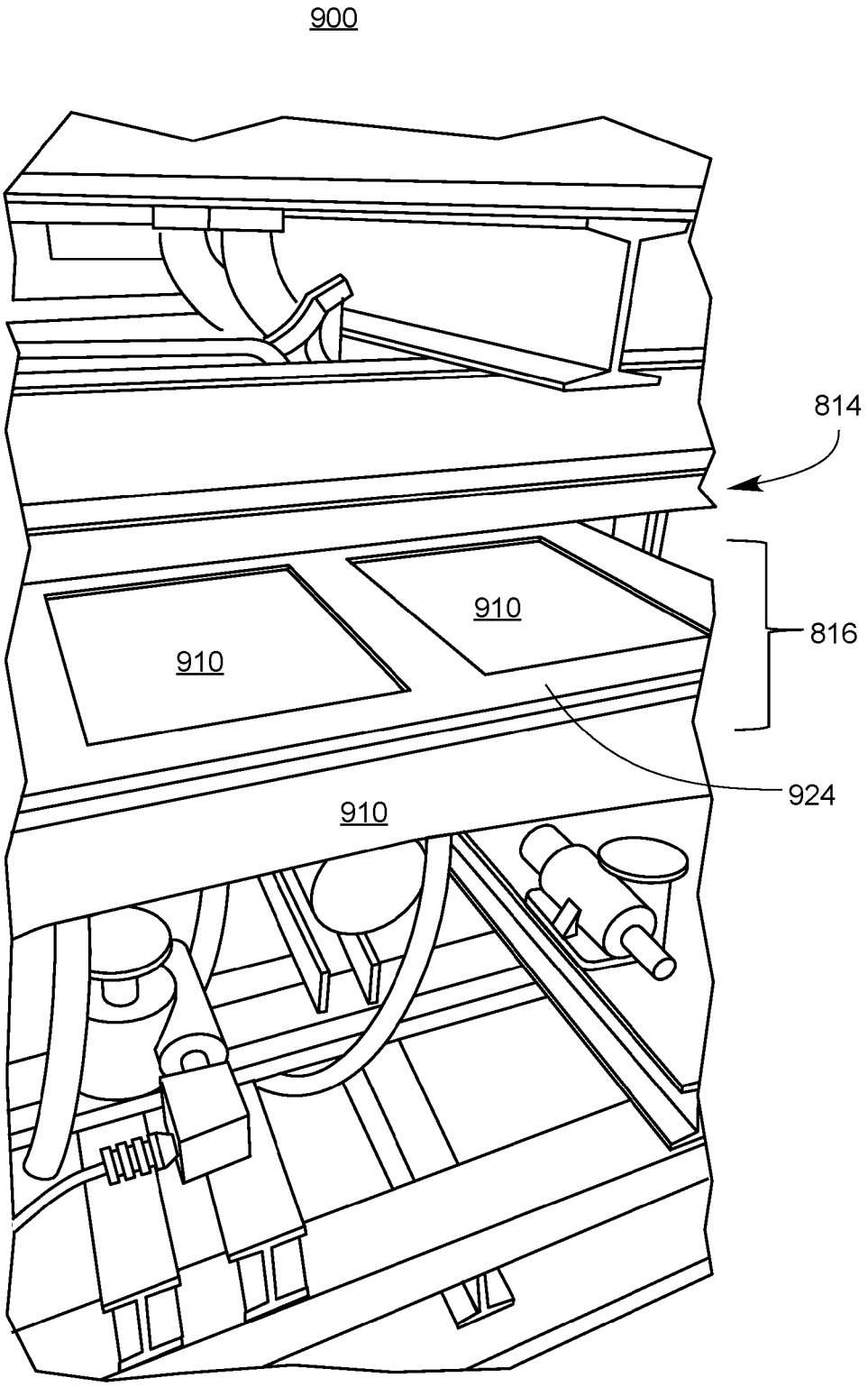
FIG. 9A is an illustrative partial perspective view of the dispensing device shown in FIG. 8, with a nanocellulose suspension placed over a filter sheet, according to one embodiment of the present invention.

FIG. 9A is a partial perspective view 900 of dispensing device 810, with the nanocellulose suspension placed over a fine filter sheet or filter membrane 910, which itself is placed on lower platen 816, under a windowed gasket 924. In this embodiment of the dispensing device, gasket 924 is sandwiched between lower platen 816 and upper platen 814, and has two windows. The nanocellulose suspension is deposited, poured, or placed over filter sheet 910 within the gasket window. Due to the small size of the nanocellulose material and the aqueous nature of the suspension, the nanocellulose suspension is not depicted explicitly. In addition, although not visible in this figure, drainage channels such as 818 in FIG. 8 may be patterned on lower platen 816 for discharging filter effluents.

Figure 9B:
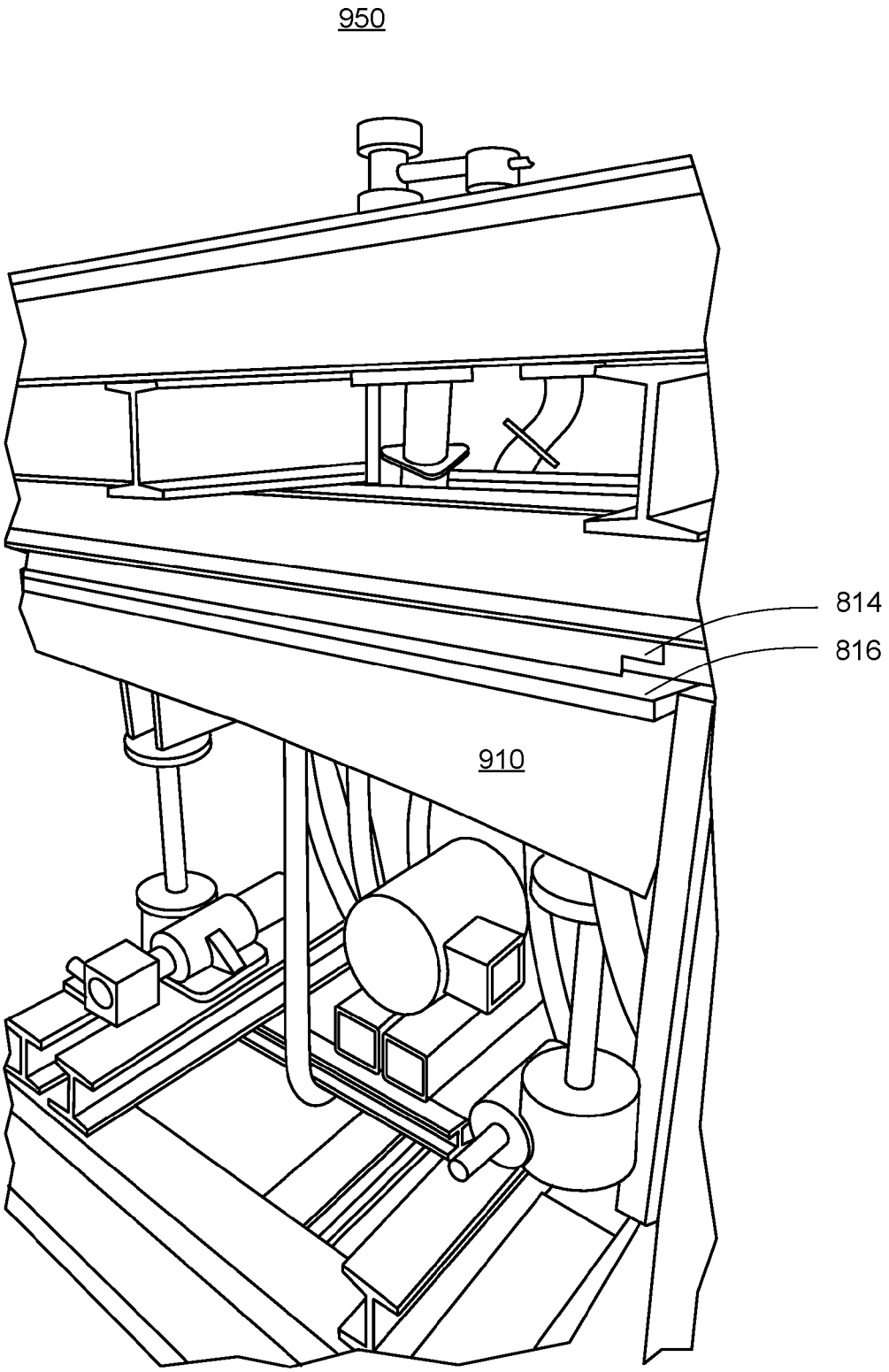
FIG. 9B is another illustrative partial perspective view of the dispensing device shown in FIG. 8, when a lower platen is raised and clamped against an upper platen to form a nanocellulose sheet, according to one embodiment of the present invention.

FIG. 9B is another partial perspective view 950 of dispensing device 810 in operation, when lower platen 816 is raised, and the aqueous nanocellulose suspension flows between the platens through the filter sheet. A filtration envelope is formed by a bottom surface of top platen 814, a top surface of the filter sheet and lower platen 816, and the inside edges of the cut-outs in the gasket. During this filtration process, a high pressure may be created within the filtration envelop to densely pack the nanocellulose fibers in the nanocellulose suspension, to ensure a constant deposition rate on the fine filter sheet. Higher pressures during sheet production improve intermolecular bonding and tangling of the nanocellulose materials, resulting in a strong yet flexible and conformable sheet of paper.

Figure 10:
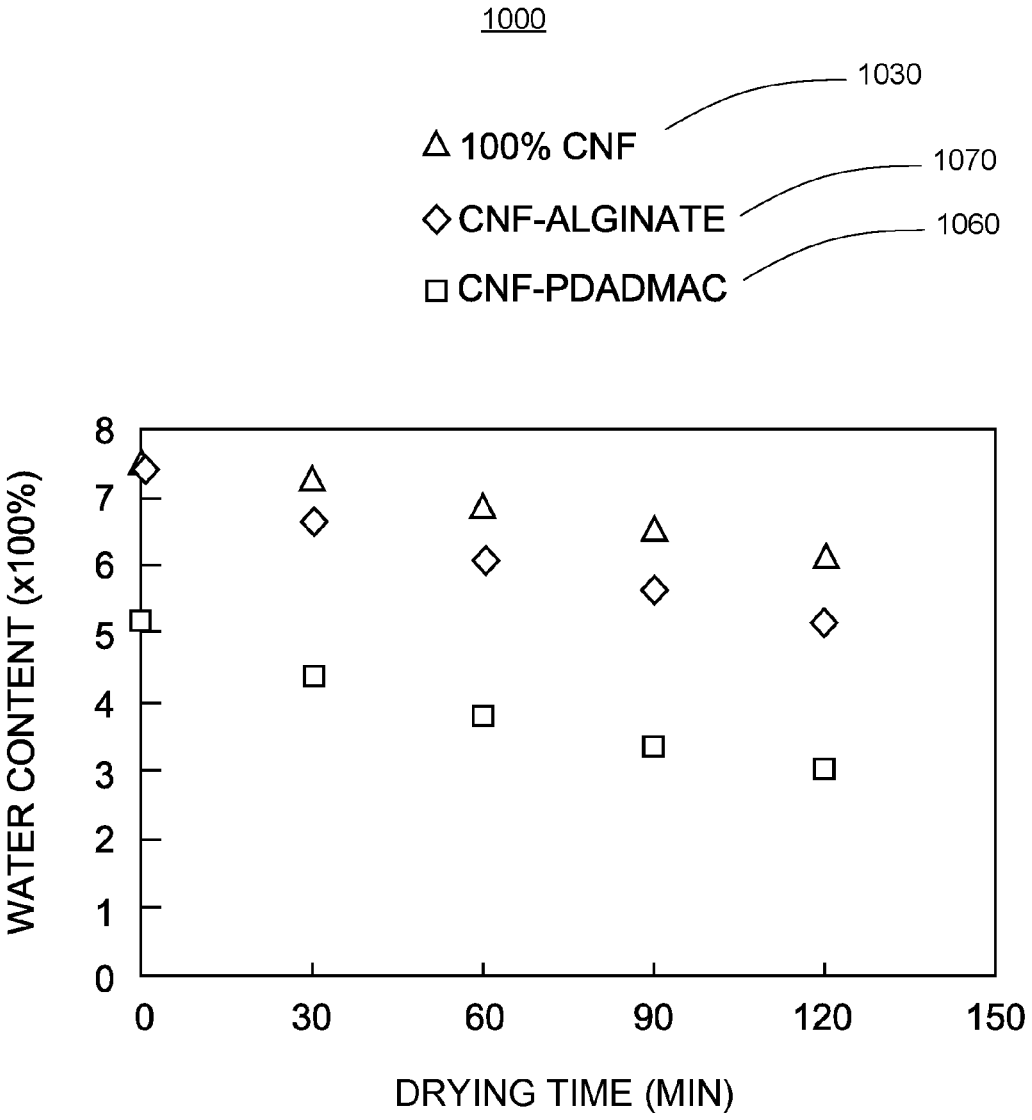
FIG. 10 is an illustrative graph showing water content measured against a drying time during the production of a nanocellulose sheet, according to one embodiment of the present invention.
Figure 11:
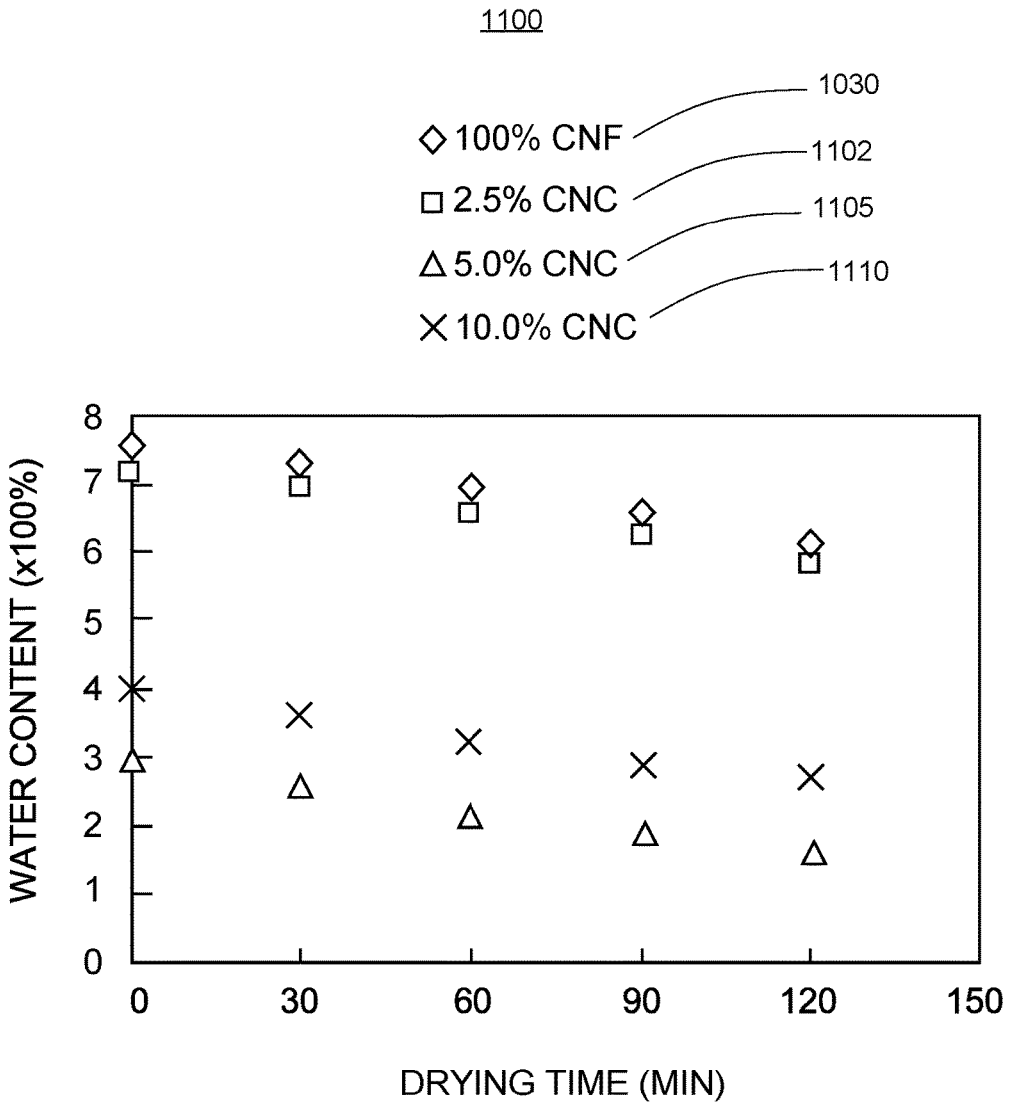
FIG. 11 is another illustrative graph showing water content measured against a drying time, according to one embodiment of the present invention.

FIGS. 10 and 11 are illustrative graphs showing water content measured against a drying time for the nanocellulose sheets formed according to processes shown in FIGS. 3, 5, 6 and 7, when different ingredients are added to the nanocellulose suspension, respectively. "Drying time" refers to a time period after the removal of a formed sheet from the dispensing device, and over which the formed sheet may be dried to a desired water content. In the examples shown in FIGS. 10 and 11, air-drying is used. Alternatively, fans, IR radiation, and other assisted drying methods may be used to further speed up the process.

In FIG. 10, water content and drying time for three types of nanocellulose sheets are compared: 100% cellulose nanofibers (CNF), CNF with Sodium Alginate added as a binding agent, and CNF with PDADMAC added as a polyelectrolyte. In FIG. 11, water content and drying time are compared for nanocellulose sheets produced with different percentages of cellulose nanocrystals (CNC).

In obtaining the graphs shown in FIGS. 10 and 11, a base nanocellulose suspension is first obtained by mixing or blending one liter (1L) of water with a stock nanocellulose slurry having 3% solids. Once an additive ingredient such as CNC is dispensed into the base nanocellulose suspension, the suspension is placed over a filter sheet in dispensing device 810. Pressurized filtration across the filter sheet is performed, and a nonwoven nanocellulose sheet is formed after the nanocellulose suspension is dewatered by a positive pressure. In these examples shown in FIGS. 10 and 11, each nonwoven nanocellulose sheet is being formed after 7 minutes of filtration. The formed nanocellulose sheets are then collected from the dispensing device and allowed to air dry, where water content of each formed sheet is measured at 30-min intervals. The vertical axis of each figure is drawn in ×100% scale, representing water content in terms of nanocellulose weight.

More specifically, filtration of the base nanocellulose suspension is performed to generate the 100% CNF graph 1030 according to FIG. 3; PDADMAC is added and blended to thoroughly mixed with the base suspension at a 1:1 ratio for nanocellulose charge compensation, to generate the CNF-PDADMAC graph 1060 according to FIG. 6; between 0.5 to 50 grams of Sodium alginate and calcium chloride are added to the base suspension as binding and cross linking agents to generate the CNF-ALGINATE graph 1070 according to FIG. 7. In addition, nanocellulose crystals are dispensed into the base suspension at different concentrations according to the process shown in FIG. 5 to generate graphs 1102, 1105, and 1110 shown in FIG. 11.

As discussed with reference to FIG. 3, when a nanocellulose suspension with 100% CNF is filtered and dried, a hydrogen-bonded network of polymer chains is formed, capable to hold several times its mass in water. In FIG. 10, 100% CNF is shown to retain approximately 800% of water in nanocellulose weight before any drying takes place, right after removal of the formed sheet from the dispensing machine.

When this hydrogen-bonded network interacts with external additives, the hydrogen bonding capabilities is inhibited, causing a decrease in an extent of hydration (EOH). Such a decrease in EOH is beneficial as it reduces overall processing time, especially when lower EOH is desired for particular applications that required specific amounts of water content with good sheet durability.

In FIG. 10, CNF with respective sodium alginate and PDADMAC additives are compared to the 100% CNF case. Sodium alginate is a negatively charged polymer that forms a hydrogel. When added as a binder, it helps the formed nanocellulose sheet to retain water well against outside forces, while also leading to a reduced drying time for a given target water content. PDADMAC is a positively charged polymer that electrostatically binds with negatively charged CNF to preventing extra wetting properties and significantly reducing EOH. By varying the proportion of PDADMAC to CNF, an extent of intrinsic ionic compensation may be tuned, indicating how many charged groups from each chain interact with one another. In FIG. 10, this ratio of 1:1, or one PDADMAC chain per CNF chain. In some embodiments, this integer multiple is between 1 and 6, inclusive.

In FIG. 11, CNF with 2.5%, 5%, and 10% of CNC additives are compared to the 100% CNF case, where the percentage is computed with respect to total nanocellulose content by weight. CNC are crystalline, with no amorphous regions with which to absorb water. CNC do not swell significantly when added to the CNF suspension, and do not exhibit ⅔ of the available H-bonding sites, resulting in lower water content. As more CNC is added, water content becomes lower for the same amount of drying time. In other words, given a target water content, production time may be significantly reduced when CNC is added. For example, when 5% is CNC is added, water content is reduced from 800% to 300% right after pressurized filtration, before air drying. Nonetheless, due to the incompressible nature of a rigid sheet, dewatering skews hydration data above 5% addition. For 10% CNC, dewatering exceeds typical processing times, resulting in a higher water content than 5% CNC when removed from the sheet former.

ADDITIONAL EMBODIMENTS

In what follows, three additional exemplary embodiments are described for nanocellulose sheet production. Although the following description contains many specifics for the purposes of illustration, and many of the features of the present invention are described in terms of each other, or in conjunction with each other, one skilled in the art will appreciate that many of these features can be provided independently of other features. Accordingly, this description of the invention is set forth without any loss of generality to, and without imposing limitations upon, the invention.

Embodiment I

1) Providing a purified nanocellulose fiber slurry where fiber dimensions exist within the nanometer range for at least one of width or length.
2) Dispersion of the nanocellulose slurry into a solution or suspension medium to form a colloidal suspension over a range of dilute concentrations by weight. The nanocellulose may be diluted with any suspension medium capable of being combined with the nanocellulose to form a stable suspension. Exemplary suspension media include water, alcohol, and oil with surfactant.
3) Dispersion of pure nanocellulose crystals (CNCs) having 50-200 nm length and 5-25 nm width into the nanocellulose slurry.
4) Optional addition of a wet binding agent such as alginate or agar in 0.001-10% w/w to increase water retention during sheet formation.
5) Optional addition of a hydrophilic pore former in 5-75% w/w to increase a solubility of the cellulose nanocrystals.
6) Addition of dermatologically active or morphology-altering particles or other additives to the nanocellulose fiber and crystal suspension.
7) Filtration of the nanocellulose fiber and crystal suspension with positive pressure or vacuum to the filter paper such that a nanocellulose sheet of uniform thickness and roughness is formed.
8) Collection of the formed, hydrated, nonwoven nanocellulose sheet.
9) Optional addition of liquid or solid active agents or ingredients by dipping the formed sheet into an ingredient slurry.
10) Cutting the formed nanocellulose sheet into a form such as a facial mask, neck wrap, and under-eye masks, among other structures.
11) Packaging of sheet in a gas impermeable package to prevent water evaporation.

Embodiment II

1) Providing a purified nanocellulose fiber slurry where fiber dimensions exist within the nanometer range for at least one of width or length.
2) Dispersion of the nanocellulose into solution or suspension medium to form a colloidal suspension over a wide range of concentrations by weight. The nanocellulose may be diluted with any suspension medium capable of being combined with the nanocellulose to form a stable suspension. Exemplary suspension media include water, alcohol, and oil with surfactant.
3) Polyelectrolyte addition:
   a. If the dispersion medium is oil-based, addition of polyelectrolyte to the oil-based emulsion containing nanocellulose, for use as flocculation agent.
   b. If the dispersion medium is water-based, adjustment of aqueous nanocellulose suspension pH to deprotonate hydroxyl groups and induce negative surface charge to create electrostatic binding sites, and dissolution of polyelectrolyte such as poly(diallyldimethylammonium chloride) (PDADMAC) or chitosan in the aqueous suspension, in an ionic charge ratio as a multiple of backbone charges of nanocellulose. For example, 1:1 or 1:6, nanocellulose to polyelectrolyte.
4) Combining with stirring the nanocellulose suspension with polyelectrolyte to form a polyelectrolyte complex network suspension of variable viscosities.
5) Addition of particulate dermatologically active ingredients or desired base material modifiers to the nanocellulose suspension.
6) Filtration of the polyelectrolyte complex suspension with positive or vacuum pressure until a sheet is formed.
7) Collection of formed, nonwoven nanocellulose sheet.
8) Optional addition of liquid or solid active agents or ingredients by dipping the formed sheet into ingredient slurry, or spraying the form sheet with one or more ingredient solutions.

9) Optional Packaging of sheet in, for example, a gas-impermeable package.

Embodiment III

1) Providing a purified nanocellulose fiber slurry where fiber dimensions exist within the nanometer range for at least one of width or length.
2) Dispersion of the nanocellulose slurry into a solution or suspension medium to form colloidal suspension over a range of dilute concentrations by weight. The nanocellulose may be diluted with any suspension medium capable of being combined with the nanocellulose to form a stable suspension. Exemplary suspension media include water, alcohol, and oil with surfactant.
3) Addition of a wet binding agent such as alginate or agar increase water retention during sheet formation.
4) Addition of a cross-linking solution such as calcium chloride to form a gel.
5) Optional addition of a hydrophilic pore former in weight percent composition from 5-75% w/w to increase pore size distribution within formed nanocellulose sheet to decrease water retention.
6) Addition of dermatologically active or morphology-altering particles or other additives to the nanocellulose suspension.
7) Filtration of the nanocellulose suspension with positive pressure or vacuum to the filter paper such that a nanocellulose sheet of uniform thickness and roughness is formed.
8) Collection of the formed, nonwoven nanocellulose sheet.
9) Optional addition of liquid or solid active agents or ingredients by dipping the formed sheet into ingredient slurry, or spraying the form sheet with one or more ingredient solutions.
10) Cutting the formed nanocellulose sheet into a form such as a facial mask, neck wrap, and under-eye masks, among other structures.
11) Packaging of sheet in a gas impermeable package to prevent water evaporation.

One of ordinary skill in the art knows that the use cases, structures, schematics, and flow diagrams may be performed in other orders or combinations, but the inventive concept of the present invention remains without departing from the broader scope of the invention. Every embodiment may be unique, and methods/steps may be either shortened or lengthened, overlapped with the other activities, postponed, delayed, and continued after a time gap, such that every user is accommodated to practice the methods of the present invention.

Although the present invention has been described with reference to specific exemplary embodiments, it will be evident that the various modification and changes can be made to these embodiments without departing from the broader scope of the invention. Accordingly, the specification and drawings are to be regarded in an illustrative sense rather than in a restrictive sense. It will also be apparent to the skilled artisan that the embodiments described above are specific examples of a single broader invention which may have greater scope than any of the singular descriptions taught. There may be many alterations made in the descriptions without departing from the scope of the present invention.

What is claimed is:

1. A method of manufacture for forming a hydrated, nonwoven nanocellulose sheet, the method comprising the steps of:

providing a nanocellulose slurry;

forming a first colloidal nanocellulose suspension by diluting the nanocellulose slurry with a suspension medium;

dispersing nanocellulose crystals (CNC) into the first nanocellulose suspension in a CNC to total nanocellulose ratio below 50%, weight per weight (w/w), to form a second nanocellulose suspension;

placing the second nanocellulose suspension over a filter sheet in a dispensing device; and forming the hydrated, nonwoven nanocellulose sheet by filtering the second nanocellulose suspension with a pressure difference across the filter sheet.

2. The method of claim 1, wherein the nanocellulose slurry comprises at least one of nanocellulose fibers (CNF) or CNC.

3. The method of claim 1, wherein the suspension medium comprises water, and the method further comprises:

drying the nanocellulose sheet to a water content between 300% to 700% of nanocellulose weight, wherein the CNC to total nanocellulose ratio is between 0.001% to 10%.

4. The method of claim 1, further comprising:

adding a CNC suspension in crystal weight percent composition between 0.001% and 10% to a surface of the hydrated, nonwoven nanocellulose sheet.

5. The method of claim 4, wherein the adding of the CNC suspension to the surface of the nanocellulose sheet is selected from the group consisting of dipping in, spraying with, and soaking in the CNC suspension.

6. The method of claim 1, wherein the second nanocellulose suspension has a nanocellulose concentration between 0.010% to 1% by weight.

7. The method of claim 1, wherein the suspension medium is oil-based.

8. The method of claim 7, further comprising:

adding a polyelectrolyte to the first or second nanocellulose suspension in a polyelectrolyte to total nanocellulose ratio between 0.01% to 84% weight per weight (w/w) as a flocculation agent.

9. The method of claim 1, wherein the nanocellulose slurry comprises both nanocellulose fibers (CNF) and CNC.

10. The method of claim 1, wherein the nanocellulose slurry has a solid content between 1% and 12% by weight.

11. The method of claim 1, wherein the first nanocellulose suspension has a mass concentration between 0.01 gram per liter to 10 grams per liter, after the diluting with the suspension medium.

12. The method of claim 1, wherein the CNC to total nanocellulose ratio in the second nanocellulose suspension is between 1% and 20% w/w.

13. The method of claim 1, wherein the CNC to total nanocellulose ratio in the second nanocellulose suspension is between 0.1% and 10% w/w.

14. The method of claim 1, wherein the nanocellulose sheet has a solid content between 10-50% by weight.

15. The method of claim 1, further comprising:

adding a binding agent to the first or second nanocellulose suspension, wherein a mass concentration of the binding agent in the nanocellulose suspension is between 0.001 grams per liter to 10 grams per liter.

16. The method of claim 1, further comprising:

adding a binding agent to a surface of the nanocellulose sheet in a binding agent to total nanocellulose ratio between 0.001% to 10% weight per weight (w/w).

17. The method of claim 1, further comprising:

adding a hydrophilic pore former to the first or second nanocellulose suspension, wherein a pore former to total nanocellulose ratio is between 5% and 75% weight per weight (w/w).

18. The method of claim 1, further comprising:

adding a hydrophilic pore former to a surface of the nanocellulose sheet, wherein a pore former to total nanocellulose ratio is between 5% and 75% weight per weight (w/w).

19. The method of claim 1, wherein the pressure difference is achieved using a positive pressure or vacuum across the filter sheet.

20. The method of claim 1, further comprising:

adding an amount of an additive ingredient to the first or second nanocellulose suspension, wherein the additive ingredient is selected from the group consisting of silver, collagen, proteins, fragrances, antioxidants, cellulose fibers, cellulose nanocrystals, nanoclay, extended release particles, micro-encapsulates, polyelectrolyte, and polyether.

* * * * *